US005557808A

United States Patent [19]

Kawai

[11] Patent Number: 5,557,808

[45] Date of Patent: Sep. 24, 1996

[54] SKIRT WITH VARIABLE SIZED PLEATS

[75] Inventor: Masateru Kawai, Kurashiki, Japan

[73] Assignee: Akashi Hifuku Kogyo Co., Ltd., Okayama, Japan

[21] Appl. No.: 527,767

[22] Filed: Sep. 13, 1995

[51] Int. Cl.[6] ..... A41D 1/14

[52] U.S. Cl. ..... 2/211; 2/243.1; 223/30

[58] Field of Search ..... 2/211, 243.1, 105; 223/28, 30, 33; D2/810–822, 757, 775, 861, 862, 857, 852, 735; 112/427

[56] References Cited

FOREIGN PATENT DOCUMENTS 1595185 6/1970 France ..... 223/28

*Primary Examiner*—C. D. Crowder
*Assistant Examiner*—Gloria Hale
*Attorney, Agent, or Firm*—Koda and Androlia

[57] ABSTRACT

A pleated skirt to contact with side portions of the body of a wearer in which a width of each of the pleats in contact with side portions of the body of a wearer is larger than a width of each of the pleats in contact with front and back surfaces of the body of the wearer. The pleated skirt is produced by forming linear pleats in front and back pieces of fabric material by use of pleat pattern molding boards in which a width in right and left side portions is larger than a width in an intermediate portion and sewing up the front and back pieces of the fabric material at the side portions.

2 Claims, 3 Drawing Sheets

SKIRT WITH VARIABLE SIZED PLEATS

BACKGROUND OF THE INVENTION

1. Industrial Field of the Invention

The present invention relates to a pleated skirt commonly used for a uniform wear.

2. Prior Art

Conventionally, in standard-type pleated skirts except hand-sewn high-quality products, pleats formed in fabric material are set linearly extending in parallel or have a width gradually increasing toward the hem. This is because of mass production in which fabric material for each of front and back bodies of a skirt is held between pleat pattern molding boards, folded into outer pleat parts and inner pleat parts alternately, and subjected to the permanent pleating process, thereby forming pleats. Therefore, the pattern boards are also arranged for forming pleats which linearly extend in parallel or have a width gradually increasing toward the hem whether the pleats are located in a central portion or in side portions of the skirt.

The above-described pleated skirt is designed considering the productivity in the first place. However, when a person wears the skirt, pleats in portions of the skirt on the hipbones and in the vicinity of the hipbones between the waist and the hips are not curved along the waist nor the hips but are opened outwardly, thus deteriorating an appearance of the skirt. When pleats are in this condition, they are expressed as "rising". Pleats rise because all the pleats of the conventional pleated skirt have a uniform width, the hip size is simply derived from the number of outer pleat parts of the pleats, and the waist is supposed to have an almost circular shape.

Actually, the waist includes side portions projected forwardly by the hipbones and has a depressed elliptic cross section.. The hips are larger than the waist and somewhat bulges backwardly. There arises no problem if a skirt has many pleats. However, for example, in a pleated skirt including 16 pleats which is now popularly in the market, a plurality of pleats rise in side portions of the waist which have a small curvature radius and contact with the hipbones and in bulging portions of the hips.

SUMMARY OF THE INVENTION

Therefore, the present invention is directed to a pleated skirt in which a plurality of pleats on the hipbones and in the vicinity of the hipbones do not rise in portions of the waist which contact with the hipbones and in bulging portions of the hips, but each of the pleats is flattened along the line connecting the waist and the hips, thus improving an appearance of the skirt when worn by a person. Also, the present invention includes pleat pattern molding boards for producing the pleated skirt.

According to the present invention, a pleated skirt in which pleats formed in fabric material are linear is characterized in that a width of each of the pleats in contact with side portions of the body of a wearer is larger than a width of each of the pleats in contact with front and back portions of the body of the wearer. The pleats may extend in parallel to one another and have a uniform width, and they may also have a width gradually increasing toward the hem. Preferably, both outer pleat parts and inner pleat parts of the pleats of a larger width are not widened, but only the width of the outer pleat parts is increased while the inner pleat parts have the same width as other inner pleat parts. A plurality of such wider pleats are preferably formed in the vicinity of the side portions of the wearer.

This pleated skirt is produced by forming linear pleats in front and back pieces of fabric material by use of pleat pattern molding boards in which side portions have a larger width than an intermediate portion, and sewing side ends of the front and back pieces of fabric material together. Preferably, if the waist size is the same, the number of pleats is smaller so that the width of the wider pleats will be increased. A pleated skirt including 16 pleats which is popular at present is considered as a standard, and 12, 14, 18 or 20 pleats are preferably formed. Incidentally, sewing of the waist is performed in substantially the same manner as the conventional skirt.

DETAILED DESCRIPTION OF THE INVENTION

The preferred embodiment of a pleated skirt according to the present invention will be described hereinafter with reference to the attached drawings.

Figure 1:
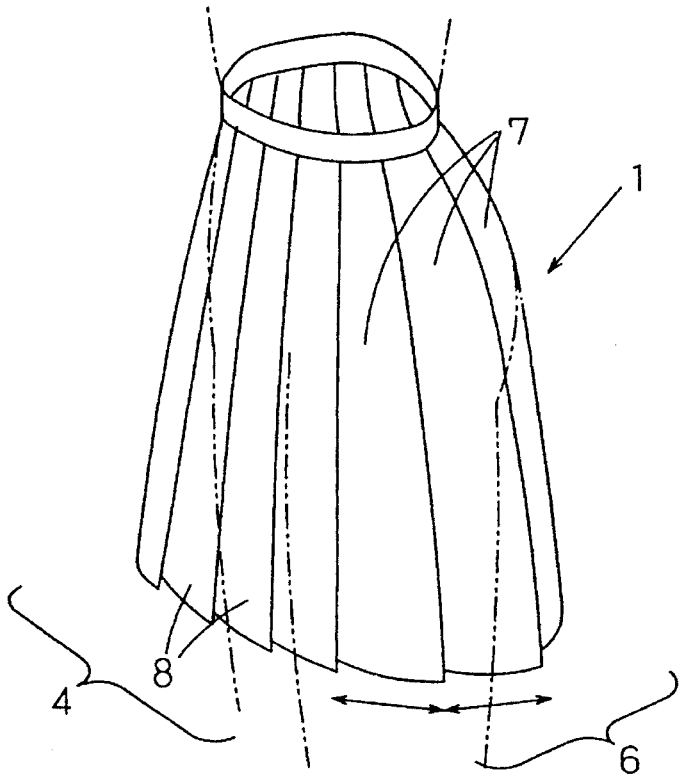
FIG. 1 is a perspective view showing a pleated skirt according to the present invention.
Figure 2:
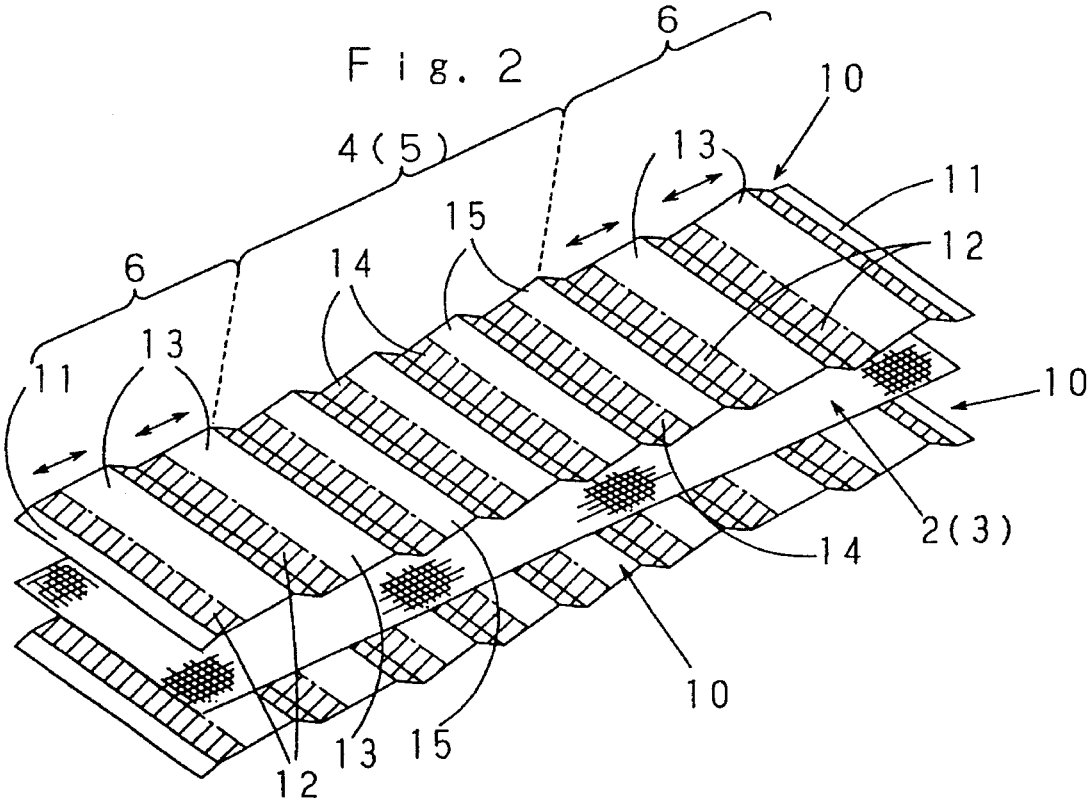
FIG. 2 is a perspective view showing pleat pattern molding boards for the pleated skirt of the invention.
Figure 3:
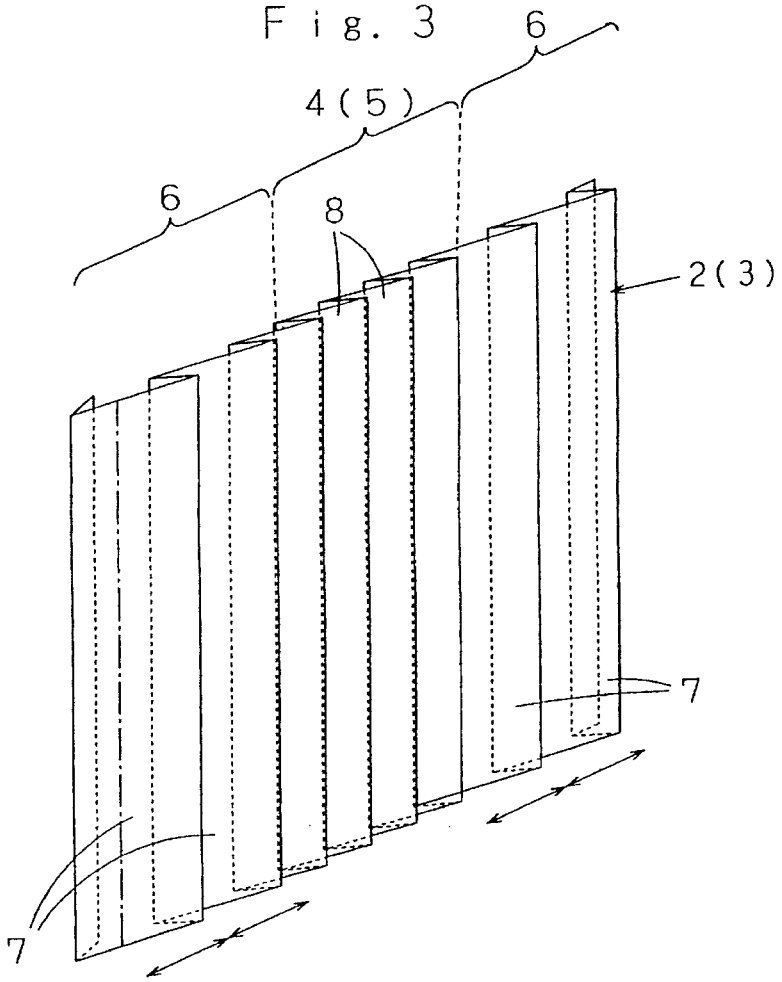
FIG. 3 is a perspective view showing a piece of fabric material which is pleated by use of the pattern boards.

FIG. 1 is a perspective view showing the pleated skirt of the invention; FIG. 2 is a perspective view showing pleat pattern molding boards for the pleated skirt when they are opened; and FIG. 3 is a perspective view showing a piece of fabric material for a front or back body of the skirt, which piece of fabric material is pleated by use of the foregoing pattern boards.

A pleated skirt 1 including 16 pleats of the illustrated embodiment is formed of two pieces, i.e., a front piece 2 and a back piece 3 of the fabric material. The front piece 2 is provided with a front pleated portion 4 comprising four pleats at the center, and with right and left side pleated portions 6 each comprising two pleats, there existing eight pleats. Similarly, the back piece 3 is provided with a back pleated portion 5 comprising four pleats at the center, and with right and left side pleated portions 6 each comprising two pleats, there existing eight pleats. In this embodiment, the total number of pleats 7 at the side pleated portions 6 of the front piece 2 and the back piece 3 is eight. However, the number of pleats may be changed as desired if it is necessary.

As shown in FIG. 1, the waist size of this pleated skirt is uniformly reduced to be smaller than the hip size at a ratio of 60:100, so as to form the almost circular waist when the waist is sewn. An appearance of the pleated skirt 1 is not different from the conventional one because the pleats 7 at the side pleated portions 6 are several mm to less than 20 mm wider than pleats 8 at the front pleated portion 4 and the back pleated portion 5. Actually, the waist size and the hip size are equal to those of the conventional skirt, and consequently, the width of the pleats 8 at the front pleated portion 4 and the back pleated portion 5 must be made slightly smaller than that of the conventional skirt by a degree corresponding to an increase in the width of the pleats 7 at the side pleated portions 6. In FIG. 1, the width of the pleats 7 at the side pleated portions 6 is exaggerated for clearly showing the width difference between the pleats 7 and 8.

An explanation will now be given with specific figures. For example, when the waist size is 60 cm, the hip size is 100 cm and the number of pleats is 16, a distance between exposed edges of neighboring uniform pleats is normally 6.25 cm. However, the width of the pleats 7 at the side pleated portions 6 is 6.5 cm which is 0.25 cm larger than the standard width whereas the width of the pleats 8 at the front pleated portion 4 and the back pleated portion 5 is 6.0 cm which is 0.25 cm smaller than the standard width.

As shown in FIG. 2, upper and lower pattern boards 10 are used in a pair so that the front piece 2 or the back piece 3 of fabric material is held between the pattern boards 10 and folded. Each of the pattern boards 10 includes margins to sew up 11 on both side ends and is designed to be folded alternately into inner pleat parts 12, 14 (hatched parts in FIG. 2) and outer pleat parts 13, 15 which extend linearly and have a uniform width. A pair of front and back pieces 2 and 3 which have been held between the pattern boards 10, folded and processed for permanent pleating (see FIG. 3) constitute the pleated skirt 1. An intermediate portion of the pattern 10 corresponds to each of the front pleated portion 4 and the back pleated portion 5 which form front and back surfaces of the pleated skirt 1. Both side portions of the pattern 10 correspond to the side pleated portions 6 where the front and back pieces 2 and 3 are sewn up. In this embodiment, the side pleated portions 6 on both sides are wide, and two side pleats 7 of a larger width are formed in each of the side pleated portions 6. In FIG. 2, the width of the pleats 7 at the side pleated portions 6 is exaggerated for clearly showing the width difference of the pleats.

Figure 4:
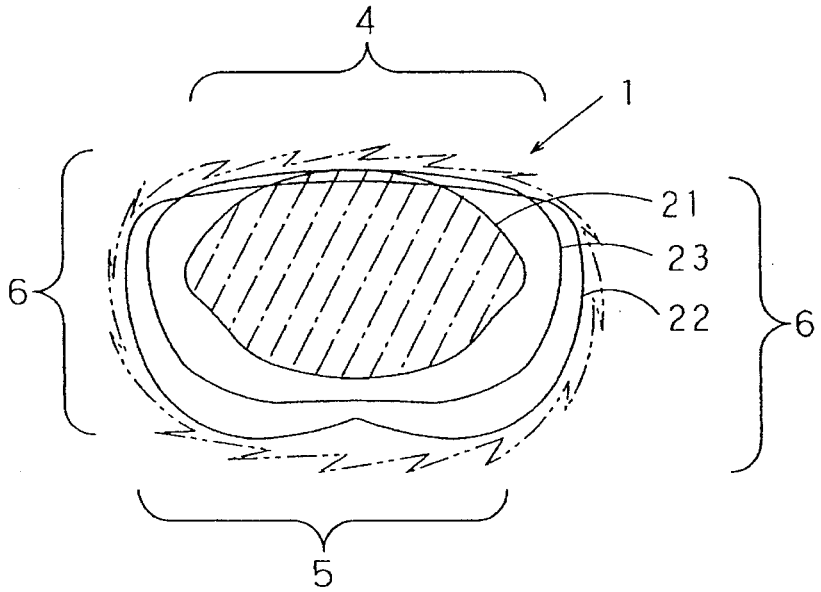
FIG. 4 is a cross-sectional view showing pleats of the pleated skirt of the invention which are well curved along the hip line.

As a method of widening the pleats at the side pleated portions 6 of the pleated skirt 1 according to the invention, widening both the inner pleat parts 12, 14 and the outer pleat parts 13, 15 of all the pleats can be suggested. However, as shown in FIGS. 2 and 3, preferably, inner pleat parts 12 of the side pleated portions 6 have the same width as inner pleat parts 14 of the front pleated portion 4 and the back pleated portion 5, and only the width of outer pleat parts 13 of the side pleated portions 6 is made relatively larger than that of outer pleat parts 15 of the front pleated portion 4 and the back pleated portion 5. As shown in FIGS. 1 and 4, the wider pleats at the side pleated portions 6 thus formed are curved along the hip line without rising, for example, in those portions of the waist where the hipbones are projected and the bulging portions of the hips exist, thereby improving the appearance of the pleated skirt.

Figure 6:
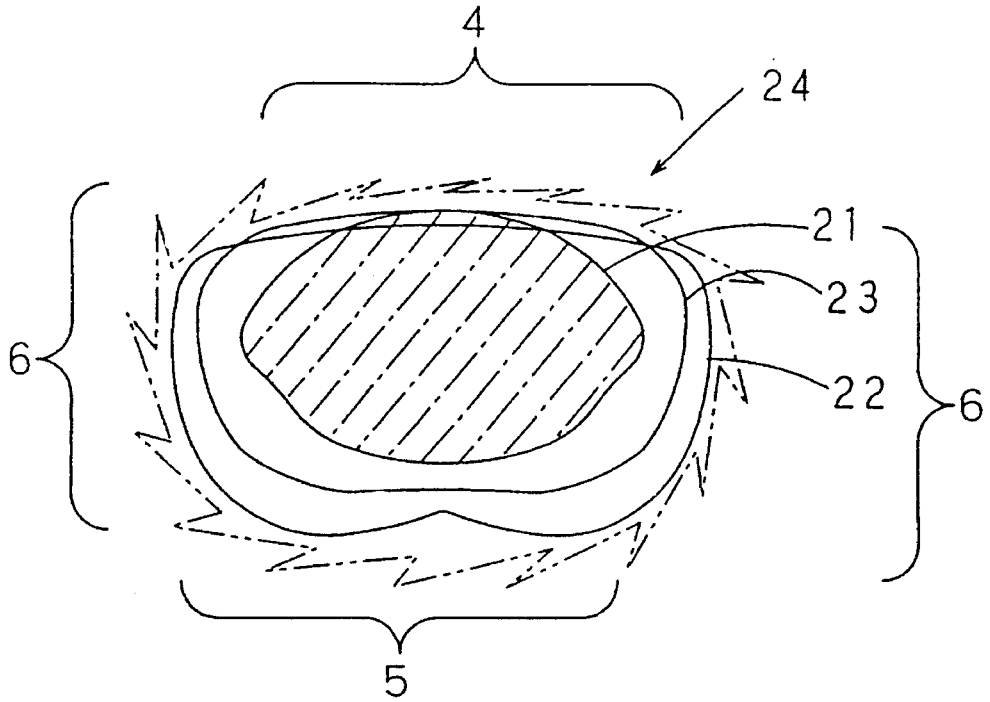
Fig. 6 (PRIOR ART)
FIG. 6 is a cross-sectional view showing pleats of a conventional pleated skirt which rise around the hip line.

FIG. 4 shows a waist line 21, a hip line 22 and an intermediate line 23 between the waist and the hips of a model. As shown in this figure, the side pleated portions 6 of the pleated skirt 1 of the invention are well curved along the hip line 22. In comparison with the invention skirt of FIG. 4, FIG. 6 shows a conventional pleated skirt 24, from which it can be seen that pleats at side pleated portions 6 rise outwardly and are not flattened along a hip line 22.

Figure 5:
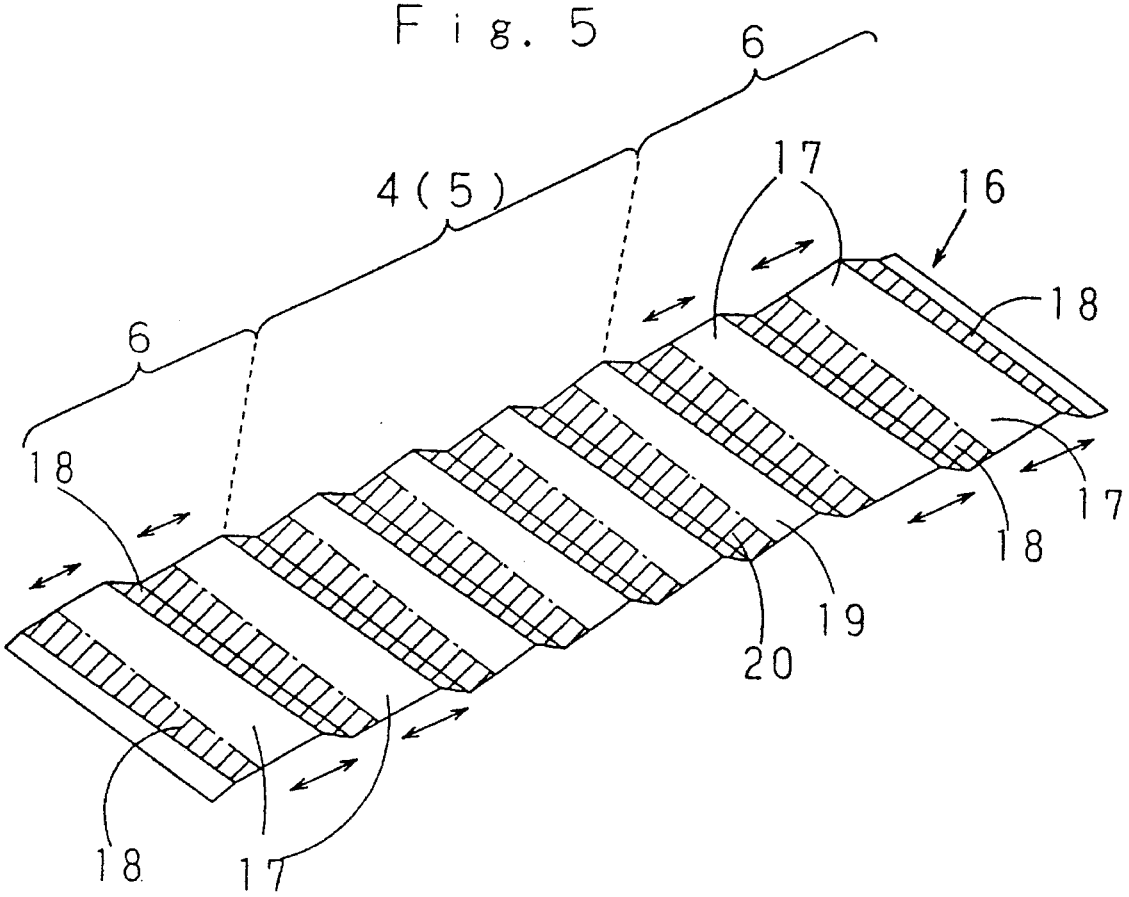
FIG. 5 is a perspective view showing a pleat pattern molding board for a pleated skirt for forming pleats which have a width gradually increasing toward the hem.

FIG. 5 is a perspective view showing another embodiment of a pleat pattern molding board 16 in which outer pleat parts 17 of side pleated portions 6 have a width gradually increasing toward the hem whereas inner pleat parts 18 of the side pleated portions 6 have a width gradually decreasing toward the hem, so as to form trapezoidal pleats. Dimensions are determined for making the whole pattern board 16 rectangular. In recent years, considering a difference between the waist size and the hip size, pattern boards for forming trapezoidal pleats have gradually prevailed. In this case as well, outer pleat parts 19 and inner pleat parts 20 of a front pleated portion 4 and a back pleated portion 5 are both decreased in width in comparison with those of the side pleated portions 6. It is more effective when the number of pleats is less than 16. However, a sufficient effect can be obtained from pleated skirts with about 12 to 26 pleats (only of an even number) which are commonly employed at present.

In the pleated skirt according to the present invention, the pleats at the side pleated portions 6 in the vicinity of the side portions of the wearer are wider than the pleats of the front pleated portion 4 and the back pleated portion 5 so that the pleats of a larger width extend to make a cross section of the skirt curved along the hipbones at the waist and the bulging portions of the hips. As a result, rising of the pleats, as shown in FIG. 6, can be prevented, and the pleats are well curved along the waist line and the hip line, as shown in FIG. 4. Similarly, when pleats of a larger width are curved in the above-mentioned manner, it is possible to prevent further rising of the pleats caused by a fastener, pockets and margins to sew up which are formed on the side portions of the skirt. In such a case, all the inner pleat parts have a uniform width, and only the outer pleat parts 13, 17 of the side pleated portions 6 are widened to make the pleats different in width. Consequently, deformation of the pleated skirt does not occur.

The front and back pieces of fabric material of the pleated skirt are held between the pattern boards and subjected to the permanent pleating process, thereby forming pleats. These front and back pieces are sewn in such a manner that both sides of the front and back pieces contact with side portions of the body of a wearer. Therefore, by forming pleats of a larger width in both the side portions of the pattern boards, a pleated skirt with side portions having pleats of a larger width can be produced. The pleats of a larger width are slightly (about several mm to less than 20 mm) wider than pleats at the front and back portions of the skirt, and consequently, the waist of the skirt can be uniformly reduced and sewn in substantially the same manner as the conventional skirt. An appearance of the pleated skirt of the invention thus produced does not differ from that of the conventional one.

With pleated skirts and their pattern boards according to the invention, productivity required for the conventional mass production is not deteriorated, and there can be provided pleated skirts which are improved in appearance when worn by a person. Besides, special sewing operations and materials are not necessary, and the operational procedures are substantially the same as the conventional method and are little increased in cost. Therefore, in production of clothing where appearances are an added value, the economical effect is remarkably high.

I claim:

1. A pleated skirt in which a plurality of linear pleats are formed in fabric material, wherein a width of each of said plurality of pleats in contact with right and left side portions of the body of a wearer is larger than a width of each of said plurality of pleats in contact with front and back portions of the body of the wearer.

2. A pleated skirt according to claim 1, wherein the plurality of pleats are formed by pleat pattern molding boards in which a width of right and left side portions for forming each of said plurality of pleats in contact with right and left side portions of the body of a wearer are larger than a width of an intermediate portion for forming each of said plurality of pleats in contact with front and back portions of the body of the wearer.

* * * * *